US005374323A

United States Patent [19]

Kuhlman et al.

[11] Patent Number: 5,374,323

[45] Date of Patent: Dec. 20, 1994

[54] NICKEL BASE ALLOY FORGED PARTS

[75] Inventors: G. William Kuhlman, Shaker Heights; Richard A. Beaumont, Avon Lake; Daniel F. Carbaugh, Macedonia; David Anderson, Brecksville; Al Farrell, West Lake, all of Ohio; Amiya K. Chakrabarti; Kenneth P. Kinnear, both of Monroeville, Pa.

[73] Assignee: Aluminum Company of America, Pittsburgh, Pa.

[21] Appl. No.: 750,127

[22] Filed: Aug. 26, 1991

[51] Int. Cl.[5] ..... C22F 1/10

[52] U.S. Cl. ..... 148/677; 72/377; 148/621; 148/624; 148/676; 148/409; 148/410; 148/426; 148/427; 148/428; 148/429

[58] Field of Search ..... 148/677, 621, 624, 409, 148/410, 426, 427, 428, 429, 676; 72/377

[56] References Cited

U.S. PATENT DOCUMENTS

| | | | |
|---|---|---|---|
| 2,570,193 | 10/1951 | Bieber et al. | 420/448 |
| 2,621,122 | 12/1952 | Gresham et al. | 420/454 |
| 3,046,108 | 7/1962 | Eiselstein | 420/448 |
| 3,061,426 | 10/1962 | Bieber et al. | 420/448 |
| 3,166,412 | 1/1965 | Bieber | 420/447 |
| 3,322,534 | 5/1967 | Ker Shaw et al. | 420/448 |
| 3,343,950 | 9/1967 | Richards et al. | 420/448 |
| 3,575,734 | 4/1971 | Muzyka et al. | 148/556 |
| 3,576,681 | 4/1971 | Barker et al. | 148/410 |
| 4,207,098 | 6/1980 | Shaw | 420/443 |
| 4,336,312 | 6/1982 | Clark et al. | 428/680 |
| 4,612,062 | 9/1986 | Nazmy et al. | 148/501 |
| 4,624,716 | 11/1986 | Noel et al. | 148/514 |
| 4,769,087 | 9/1988 | Genereux et al. | 148/677 |
| 4,793,868 | 12/1988 | Chang | 148/677 |
| 4,820,356 | 4/1989 | Blackburn et al. | 148/675 |
| 4,825,522 | 5/1989 | Iwai et al. | 29/889.2 |
| 4,917,738 | 4/1990 | Takano et al. | 148/325 |
| 4,957,567 | 9/1990 | Krueger et al. | 148/676 |
| 4,981,644 | 1/1991 | Chang | 420/442 |
| 5,059,257 | 10/1991 | Wanner et al. | 148/607 |
| 5,080,727 | 1/1992 | Aihara et al. | 148/648 |
| 5,087,305 | 2/1992 | Chang | 148/410 |
| 5,120,373 | 6/1992 | Miller et al. | 148/676 |
| 5,131,961 | 7/1992 | Sato et al. | 148/677 |

OTHER PUBLICATIONS

Howard E. Boyer and Timothy L. Gall, eds., *Metals Handbook Desk Edition;* "Forging", pp. 24–29 to 24∝27; American Society for Metals, 1985.

*Primary Examiner*—Richard O. Dean
*Assistant Examiner*—Robert R. Koehler
*Attorney, Agent, or Firm*—Andrew Alexander; David W. Pearce-Smith

[57] ABSTRACT

Disclosed is a large alloy forging, the forging having an alloy composition selected from one of a nickel base alloy, a cobalt-chromium-nickel base alloy, a nickel-cobalt base alloy and an iron-nickel-chromium-molybdenum alloy, the forging having a grain size of ASTM grain size 3 or finer, as measured by ASTM method E112 and having a tensile strength in the range of 135 to 175 KSI.

76 Claims, 1 Drawing Sheet

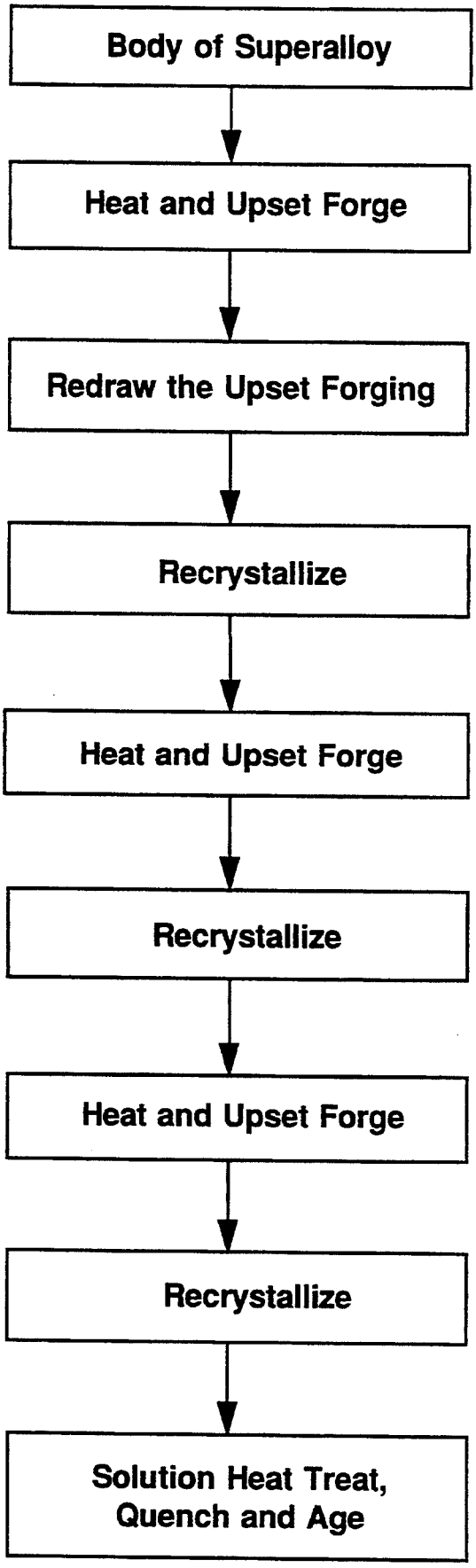
Body of Superalloy
Heat and Upset Forge
Redraw the Upset Forging
Recrystallize
Heat and Upset Forge
Recrystallize
Heat and Upset Forge
Recrystallize
Solution Heat Treat, Quench and Age

NICKEL BASE ALLOY FORGED PARTS

BACKGROUND OF THE INVENTION

This invention relates to forged parts fabricated from alloys such as nickel-base alloys, and more particularly, it relates to large forged parts having fine grain size fabricated from nickel-base alloys.

Nickel-base alloys, iron-nickel-chromium-base alloys nickel-cobalt or cobalt-base alloys and the like have been found to be difficult to fabricate, particularly into large forged parts, and consistently obtain fine grain size which aids in achieving mechanical properties in the forged parts. The large forged parts referred to herein include turbine discs or spacers which can weigh 7,500 to 24,000 pounds.

The present invention provides a product and a process for achieving fine grain size and improved mechanical properties in large forged parts fabricated from superalloys such as nickel alloys, iron-nickel, nickel-cobalt and cobalt-base alloys and the like.

OBJECTS OF THE INVENTION

It is an object of the present invention to provide large forged parts from heat resistant alloys such as iron-nickel, nickel and nickel-cobalt and cobalt-base alloys.

It is a further object of this invention to provide large forged parts from such alloys having improved mechanical properties.

It is a further object of this invention to provide large forged parts from such alloys having uniformly fine grain size.

It is yet another object of this invention to provide large forged parts from iron-nickel-base alloys and the like having grain size of ASTM grain size 3 or finer as measured by ASTM method E112, Heyn Intercept Method, and being substantially uniform throughout the forged part.

It is still a further object of this invention to provide the forging from such alloys, the forging having enhanced ultrasonic transmission characteristics of at least 15 to 20% reduction in signal attenuation of an ultrasonic signal operating at a frequency of 2.25 MHZ and by at least a 15 to 20% improvement in return frequency of the same signal operating at 2.0 to 2.25 MHZ.

SUMMARY OF THE INVENTION

In accordance with these objects, there is provided a process for fabricating recrystallized, large forged parts having fine grain size and improved tensile properties by providing a body of an alloy selected from one of a nickel-base alloy, an iron-nickel-chromium-molybdenum alloy, cobalt-chromium-nickel alloy, nickel-cobalt and cobalt base alloy. The body is heated to a temperature above the recrystallization temperature of the alloy and subjected to a first upset forging operation to provide a reduction of at least 50% of the original length of the body. The body is then drawn at least once before subjecting it to a recrystallization and cooling treatment. The body is then reheated to a temperature above the recrystallization temperature before subjecting to a second upset forging operation to provide a reduction of at least 40 or 50% of its original length. Thereafter, the second upset forging is subjected to another recrystallization and cooling treatment. The second upset forged body is heated above the recrystallization temperature and then subjected to a third upset forging operation which reduces its length at least 60%, preferably at least 75%. After the third upset, it may be solution heat treated, quenched and aged to provide a forged product having improved properties and fine grains distributed uniformly.

BRIEF DESCRIPTION OF THE DRAWING

The sole FIGURE shows the preferred process steps of the invention.

DETAILED DESCRIPTION OF THE PREFERRED EMBODIMENTS

In accordance with the invention, there is provided a process, as shown in the FIGURE, for fabricating large forged parts having fine grain size and improved tensile properties. Examples of the forged parts are turbine discs having a thickness of about 11 inches and a diameter of about 72 inches and weighing about 13,000 pounds. Examples of other parts which may be fabricated in accordance with the invention are spacers, about 13 inches thick and 60 inches in diameter, and even larger turbine disc, as high as 21,000 lbs or higher, for example.

Examples of alloys which may be processed in accordance with the invention include the AISI Standard Austenitic stainless steels, the higher-nickel austenitic alloys, the precipitation-hardening stainless steels, the iron-nickel-chromium-molybdenum alloys, the nickel-base alloys, the cobalt-chromium-nickel-base alloys and nickel-cobalt-base alloys, compositions of which are provided in the Metals Handbook, Vol. I, page 467, which compositions are incorporated herein by reference. The iron-nickel-chromium-molybdenum alloys, the nickel-base alloys and the cobalt-chromium-nickel-base alloys, referred to as superalloys, are provided herein for convenience as follows:

TABLE 1

| | Nominal Compositions of Wrought Heat-Resisting Alloys | | | | | | | | | | | | |
|---|---|---|---|---|---|---|---|---|---|---|---|---|---|
| Alloy | C | Mn | Si | Cr | Ni | Co | Mo | W | Cb | Ti | Al | Fe | Other |
| | | | | Iron-Nickel-Chromium-Molybdenum Alloys | | | | | | | | | |
| 19-9 DL | 0.30 | 1.10 | 0.60 | 19 | 9 | — | 1.25 | 1.25 | 0.4 | 0.3 | — | rem | — |
| 17-14 Cu, Mo | 0.12 | 0.75 | 0.50 | 16 | 14 | — | 2.50 | — | 0.4 | 0.3 | — | rem | 3 Cu |
| A-286 | 0.08 | 1.35 | 0.50 | 15 | 26 | — | 1.25 | — | — | 2.0 | 0.25 | rem | 0.3 V |
| Discaloy | 0.06 | 1.00 | 0.70 | 14 | 26 | — | 3.00 | — | — | 1.7 | 0.25 | rem | — |
| 16-25-6 | 0.06 | 1.35 | 0.70 | 16 | 25 | — | 6.00 | — | — | — | — | rem | 0.15 N |
| Incoloy 901 | 0.05 | 0.50 | 0.35 | 13 | 40 | — | 6.00 | — | — | 2.5 | 0.20 | rem | — |
| D-979 | 0.05 | 0.50 | 0.50 | 15 | 45 | — | 4.00 | 4.00 | — | 3.0 | 1.00 | rem | 0.01 B |
| | | | | Nickel-Base Alloys | | | | | | | | | |
| Nimonic 75 | 0.12 | 1 max | 1 max | 20 | rem | — | — | — | — | 0.40 | — | 5 max | — |
| Nimonic 80 | 0.1 max | 1 max | 1 max | 20 | rem | 2 max | — | — | — | 2.25 | 1.25 | 5 max | — |
| Nimonic 80A | 0.1 max | 1 max | 1 max | 20 | rem | 2 max | — | — | — | 2.25 | 1.25 | 5 max | — |
| Nimonic 90 | 0.1 max | 1 max | 1 max | 20 | rem | 18 | — | — | — | 2.50 | 1.50 | 5 max | — |
| M-252 | 0.15 | 0.5 | 0.5 | 19 | rem | 10 | 10 | — | — | 2.50 | 1.00 | 2 | 0.005 B |

TABLE 1-continued

| Alloy | C | Mn | Si | Cr | Ni | Co | Mo | W | Cb | Ti | Al | Fe | Other |
|---|---|---|---|---|---|---|---|---|---|---|---|---|---|
| | | Nominal Compositions of Wrought Heat-Resisting Alloys | | | | | | | | | | | |
| Hastelloy C | 0.15 max | — | — | 16.5 | rem | — | 17 | 4.5 | — | — | — | 6 | — |
| Hastelloy R-235 | 0.15 | — | — | 15.5 | rem | — | 5 | — | — | 2.50 | 2.00 | 10 | — |
| Hastelloy W | 0.12 max | — | — | 5.0 | rem | — | 25 | — | — | — | — | 5.5 | 0.6 max V |
| Hastelloy X | 0.15 | — | — | 22.0 | rem | — | 9 | — | — | — | — | 20 | — |
| Inconel | 0.04 | 0.35 | 0.20 | 15 | 78 | — | — | — | — | — | — | 7 | — |
| Inconel "X" | 0.04 | 0.70 | 0.30 | 15 | 73 | — | — | — | 1 | 2.5 | 0.9 | 7 | — |
| Inconel "X" 550 | 0.04 | 0.70 | 0.40 | 15 | 73 | — | — | — | 1 | 2.3 | 1.2 | 7 | — |
| Inconel 700 | 0.13 | 0.08 | 0.25 | 15 | 45 | 30 | 3 | — | — | 2.8 | 3.2 | 1 | — |
| Waspaloy | 0.1 | — | — | 19 | rem | 14 | 4 | — | — | 3 | 1.3 | 1 | tr B, Zr |
| Udimet 500 | 0.1 | — | — | 19 | rem | 19 | 4 | — | — | 3 | 2.9 | 4 max | tr B |
| Udimet 700 | 0.1 | — | — | 15 | rem | 19 | 5 | — | — | 3.5 | 4.5 | 4 max | 0.03 B |
| Unitemp 1753 | 0.24 | 0.05 | 0.10 | 16 | rem | 7 | 1.5 | 8 | — | 3 | 2 | 9.5 | tr B, Zr |
| René41 | 0.1 | — | — | 19 | rem | 11 | 10 | — | — | 3 | 1.5 | 3 | tr B |
| | | Cobalt-Chromium-Nickel-Base Alloys | | | | | | | | | | | |
| S-816 | 0.40 | 1.2 | 0.4 | 20 | 20 | rem | 4 | 4 | 4 | — | — | 4 | — |
| V-36 | 0.25 | 1.0 | 0.4 | 25 | 20 | rem | 4 | 2 | 2 | — | — | 3 | — |
| L-605, HS-25, WF-11 | 0.15 | 1.5 | 0.5 | 20 | 10 | rem | — | 15 | — | — | — | 2 | — |
| S-590 | 0.40 | 1.2 | 0.4 | 20 | 20 | 20 | 4 | 4 | 4 | — | — | rem | — |
| N-155, HS-95 | 0.15 | 1.5 | 0.5 | 21 | 20 | 20 | 3 | 3 | 1 | — | — | rem | 0.15 N |

INCONEL 718 is an alloy containing 17–21 wt. % Cr, 0.65–1.15 wt. % Ti, 0.20–0.8 wt. % Al, 50–55 wt. % Ni, 2.8–3.3 wt. % Mo, up to 1 wt. % Co, up to 0.08 wt. % C, up to 0.006 wt. % B, up to 0.35 wt. % Mn, up to 0.35 wt. % Si, up to 0.015 wt. % P, up to 0.015 wt. % S, up to 0.30 wt. % Cu, the sum of Nb+Ta being in the range of 4.75 to 5.5 wt. %, the balance being Fe.

Iron-nickel-chromium-molybdenum which may be used can have (by wt. %) 10–50 Ni, 10–25 Cr, 0–10 Mo, the balance Fe, and may contain Mn, W. Cb, Nb, Ti, Al up to about 10 wt. %. Representative of such alloys are INCONEL 706, INCONEL 718 and A286.

Nickel-based alloys suitable for use in the invention can have (by wt. %) 10–30 Cr, 0–13 Co, 0–25 Mo, the balance nickel with elements such as W, Cb, Nb, Ta, Ti and Al which may be added up to 10 wt. %. Examples of such alloys are INCONEL 625, NIMONIC 90 and NIMONIC 901.

Cobalt-chromium-nickel-based alloys can have (by wt. %) 10–30 Cr, 10–30 Ni, 1–4 Mo, 1–15 W, the balance cobalt, with other elements which may be added up to 10 wt. % are Mn, Cb and Nb. Examples are WASPOLOY, UDIMET 700, UDIMET 720 and ASTROLOY.

It will be appreciated that modifications may be made to these alloy compositions and such modifications are contemplated within the purview of this invention.

A body of the alloy is provided as an ingot. Typically, the ingot is about 28 to 38 inches in diameter and about 70 to 120 inches in length. Ingots which are square or rectangular in cross section may also be used, depending on the end product desired. Ingots of such alloys are often characterized by coarse, equiaxed or columnar as-cast grains which may range from 0.1 to 1 inch or larger in the major dimension. For purposes of nomenclature, the length or height of the ingot is referred to as the A direction, the width is referred to as the B direction and thickness as the C direction. Obviously, in a round or square ingot, the dimensions are the same in the B or C direction.

By fine grain size as used herein is meant ASTM Grain size 3 or finer as measured by ASTM E112 Heyn Intercept Method where the largest dimension of the grain is measured and the grain size is calculated.

By recrystallized is meant that at least 90%, preferably greater than 95% of the material is recrystallized.

Typically, an ingot of the alloy employed is heated from about 50° to 350° F. above its recrystallization temperature. For INCONEL 706, for example, this is about 2000° F. The ingot may be heated to about 2050° F., for example. The ingot should be held at this temperature for a time sufficient to obtain substantially uniform temperature, which time can be as long as 2 to 10 hours and which is suitable for hot working.

After the heating treatment, the ingot is subjected to a first hot upset forging operation which is accomplished by squeezing the ingot to reduce its height or length, i.e., in the A direction. For INCONEL 706, preferably the forging upset is performed while the ingot is maintained in the temperature range of 1700° to 2050° F. The upset forging can be performed in one step so as to impart work to the ingot which reduces its length greater than 40% of its original length, preferably greater than 50% and typically in the range of 50 to 60%. During the forging operation, heated dies may be used to aid maintaining the ingot in the temperature range for purposes of hot working. For example, the dies may be maintained in the temperature range of 600° to 1000° F., typically greater than 800° F. For purposes of the present invention, while reference is made to an ingot, it should be understood that part of an ingot may be used and reference herein to a body is meant to include a full ingot or part of an ingot or billet.

After the first upset forging, the body is redrawn or reworked. The redrawing is performed preferably in the range of 50° to 350° F. above the recrystallization temperature. For INCONEL 706, this temperature is about 1700° to 2000° F. The redrawing is provided in an amount which preferably brings the ingot or body back to about its original dimensions. For example, in a round ingot, the redrawing can be sufficient to work the ingot back to about its original diameter. However, it is within the purview of the invention to provide a working amount equivalent to redrawing to the original ingot dimension plus or minus 20% of the original length, for example.

It should be noted that the upset and redraw operation can be performed in one step or in a number of steps. That is, the body may be upset forged and redrawn several times to impart the desired amount of work or equivalent amount of work to the body.

By redrawing as used herein is meant working the upset forged body by rolling, drawing or forging, for example.

After the redrawing step, preferably the body is heated to a temperature sufficiently high to cause the redrawn body to recrystallize. For example, for INCONEL 706, the temperature is about 2000° F. The temperature can be higher than the recrystallization temperature without any detrimental effects. Typical time at temperature is about 5 to 8 hours. The redrawn body is then cooled by air to ambient.

After recrystallization and cooling, the redrawn body is again heated above the recrystallization temperature, typically in the range of 50° to 250° F. above the alloy's recrystallization temperature, for example 2000° F. for INCONEL 706. The time at temperature can be 2 to 10 hours. The redrawn body is then subjected to a second upset forging operation in the A direction which reduces it at least 40% of its original length, preferably 50 to 70% and typically about 60%. During this forging operation which can be performed in a single step, the body is preferably maintained in a temperature range of 1700° to 2000° F.

The forging dies can be heated, e.g., to 800° F. or above, to aid in maintaining the body at temperature during the second forging operation.

After the second upset forging thermal operation, preferably the body is subjected to a second recrystallization thermal treatment. At a temperature of 50° to 200° F. above the recrystallization temperature of the alloy, the body can be held for 2 to 10 hours and then cooled to ambient.

Before subjecting the body to a third upset forging operation to provide the final product, the body is heated to a temperature above the recrystallization temperature. The heating may be to a temperature about 50° to 100° F. above the recrystallization temperature. For INCONEL 706, preferably this would be in the range of 1900° to 1950° F. For purposes of the forging operation, it is important that the body is maintained at a high temperature, e.g., in the range of 1800° to 1950° F. for INCONEL 706, during forging in order to aid in developing the fine grain size as strain energy is imparted in this temperature range. To aid in maintaining the body at temperature during the third forging operation, the forging dies can be heated to a temperature range of 1100° to 1400° F. and preferably not less than 1200° F. Further, the body may be insulated to maintain its temperature in the desired range during forging. A suitable insulating material that can be used which does not interfere with the forging operation is fiberglass. The fiberglass can also function as a lubricant. The fiberglass may be covered with a foil in a layered arrangement. Stainless steel foil or similar foil may be used. Thus, the foil-covered insulation may be wrapped around the body and maintained there during the third deformation process.

The amount of deformation provided during the third upset forging is also important. That is, in this step, the amount of work applied is sufficient to reduce the length of the forging by 50 to 70%, preferably sufficient to reduce the length by at least 60% and typically to reduce the length by 55 to 65%.

For purposes of further developing the fine grain structure which is important in the present invention, the forged product may be subjected to a third recrystallization treatment wherein the product is heated to a temperature typically 50 to 200° F. above the recrystallization treatment where the product is held for 2 to 10 hours and then permitted to cool either at air cooling rate or controlled cooling.

The forged product which has the configuration of a disc may be air cooled to about 1300° to 1600° F. and further cooled at a controlled rate of about 10 to 100° F./hr, preferably 20° to 60° F./hr and typically about 50° F./hr to room temperature. Alloys such as INCONEL 706 may be air cooled to room temperature. Thereafter, the forged product may be machined to an appropriate configuration before being solution heat treated, quenched and aged.

For a forged product produced from INCONEL 706, the solution heat treatment is performed in the range of 1800° to 1900° F. for 4 to 6 hours, quenched in oil and aged by heating to 1350° F. and held for 16 hours. Then the product is cooled at about 100° F./hr to 1150° F. and held for 22 to 30 hours.

This process is particularly useful in producing large forgings, e.g., 5000 lbs or more, having improved mechanical properties. The process imparts a uniform level of deformation strain to the product. Further, the process recrystallizes large as-cast grains and produces a fine grain size, e.g., ASTM grain size 3 or finer. This aids in producing enhanced fatigue and tensile properties and ultrasonic transmission characteristics.

The forged disc provided by the process of the invention is useful as turbine discs and spacers on which the turbine blades are mounted. Typical dimensions for such components are about 60 to 90 inches in diameter and 8 to 15 inches thick. When finish machined, the discs are used in land-based turbines and power generators where temperatures can reach 600° to 1300° F. under loads.

INCONEL 706 forgings produced in accordance with the invention can have an ultimate tensile strength in the range of 170 to 190 KSI, yield strength in the range of 135 to 165 KSI and Charpy Impact Values of 25–45 ft/lb.

Further, with respect to the forging and recrystallization steps, it is preferred that each successive step is carried out at a lower temperature than the step before.

The following example is further illustrative of the present invention.

EXAMPLE

Nickel-base alloy INCONEL 706 (composition in wt. %, 41.4 Ni, 16 Cr, 1.7 Ti, 2.9 Cb and Ta and 0.2 Al, the balance Fe was provided as an ingot 31 inches in diameter and 71 inches in length. The ingot was first heated to 2050° F., which was above the recrystallization temperature, and then worked or upset forged an amount which reduced the length to 35 inches (about 50%) in one step. During the forging operation, the forging dies were maintained at a temperature of about 800° F. The forged body was then redrawn to its original ingot diameter by multiple draw forging steps in the temperature range of 1700° to 2050° F. The redrawn ingot was then placed in a furnace set at about 2050° F. to recrystallize the internal structure of the ingot. After the forged body had reached temperature, it was held at temperature for 2 hours and then permitted to air cool to ambient temperature. For the second upset forging operation, the ingot was heated to about 2000° F. and then upset forged to reduce the length of the body 50% using dies heated to 800° F. The forged body was then placed in a furnace at 2000° F. and held for 1 hour after reaching 2000° F. and then permitted to air cool to ambient temperature. The forged body was then wrapped in an insulating material comprised of stainless steel foil and fiberglass to aid in maintaining the body at temperature and in providing lubrication for the last forging operation. The wrapped-forged body was heated to about 1950° F. and then upset forged to reduce its length by 60% using dies heated to 1200° F. to provide a disc-shaped product. The upset product was placed in a furnace at 1950° F. for about 1 hour and then air cooled.

The recrystallization steps referred to herein can be optional as noted; however, it is believed that such recrystallization treatments aid in allowing uniform fine grain size which is important to properties of the turbine disc or spacer.

The disc product was rough machined, solution heat treated by heating to 1870° F., oil quenched and aged at 1350° F. for 16 hours.

The resulting disc product has an ASTM grain size of 3 to 4, ultimate tensile strength of 180 KSI a yield strength of 140 KSI and a Charpy Impact of 30 to 40 ft/lbs for tangential grain orientation.

Having thus described the invention, what is claimed is:

1. A process for fabricating recrystallized large forged parts having fine grain size and improved tensile properties by:

(a) providing a body of an alloy selected from one of a nickel-base alloy, an iron-nickel-chromium-molybdenum alloy, cobalt-chromium-nickel alloy, nickel-cobalt and cobalt-base alloy;

(b) heating said body to a temperature above the recrystallization temperature of the alloy;

(c) subjecting said body to a first upset forging operation to provide a reduction of at least 50% of the original length of the body;

(d) drawing said body after said first upset forging;

(e) subjecting the body after drawing to a first recrystallization treatment and cooling;

(f) reheating said body to a temperature above the recrystallization temperature;

(g) subjecting the reheated body to a second upset forging operation to provide a reduction of at least 25% of the original length of the body;

(h) subjecting the second upset forging to another recrystallization treatment and cooling;

(i) heating and maintaining said second upset forged body above the recrystallization temperature while subjecting said second upset forged body to a third upset forging operation to provide a reduction in the length of at least 75% of the original length of the second upset forged body; and (i) solution heat treating, quenching and aging to provide a forged product having improved tensile properties.

2. The process in accordance with claim 1 wherein after said third upset forging operation, the forging is subjected to a recrystallization treatment and cooled.

3. The process in accordance with claim 1 wherein after drawing, the body is heated above the recrystallization temperature and subjected to a further upset forging operation followed by drawing.

4. The process in accordance with claim 1 wherein each successive recrystallization treatment is at a lower temperature than an earlier recrystallization treatment.

5. The process in accordance with claim 1 wherein each upset forging operation is performed at a lower temperature than an earlier upset forging operation.

6. The process in accordance with claim 1 wherein after each recrystallization treatment the body is rapidly cooled.

7. The process in accordance with claim 1 wherein in step (e) the body is heated in the range of 50° to 300° F. above the recrystallization temperature.

8. The process in accordance with claim 1 wherein in step (h) the forging is heated above the recrystallization temperature 25° to 250° F.

9. The process in accordance with claim 2 wherein the forging is heated 10° to 200° F. above the above the recrystallization temperature of the alloy.

10. The process in accordance with claim 1 wherein the alloy is selected from INCONEL 706, Inconel 718, Inconel 625, WASPALOY, UDIMET 700, UDIMET 720, A286, NIMONIC 90, NIMONIC 901 and ASTROLOY.

11. The process in accordance with claim 1 wherein the product, after solution heat treating, quenching and aging, has a grain size of ASTM grain size 3 or finer.

12. The process in accordance with claim 1 wherein the product has an improved ultrasonic transmission characteristic of at least 20% reduction in signal attenuation at frequencies of 1.5 to 2.5 MHZ.

13. The process in accordance with claim 1 wherein the body is circular in cross section.

14. The process in accordance with claim 1 wherein the body in step (b) is heated to about 50° to 300° F. above recrystallization temperature.

15. The process in accordance with claim 1 wherein in the first upset forging step the body is reduced in length between 60 to 70% of its original length.

16. The process in accordance with claim 1 wherein the body is maintained at a temperature range of 1700° to 2050° F. during said first upset forging operation.

17. The process in accordance with claim 1 wherein during said redrawing the body is maintained at a temperature range of 1700° to 2050° F.

18. The process in accordance with claim 1 wherein said redrawing imparts to the upset forge body an amount of work substantially equivalent to that imparted by said first upset forging.

19. The process in accordance with claim 1 wherein in step (e) the redrawn body is heated to above 2000° F.

20. The process in accordance with claim 1 wherein in step (e) the redrawn body is heated to 50° to 250° F. above recrystallization temperature.

21. The process in accordance with claim 1 wherein in step (e) the body is air cooled.

22. The process in accordance with claim 1 wherein in step (f) the body is heated to 50° to 250° F. above recrystallization temperature.

23. The process in accordance with claim 1 wherein the body is maintained at a temperature in the range of 1700° to 2000° F. during said second upset forging operation.

24. The process in accordance with claim 1 wherein in the second upset forging operation the length of the body is reduced by an amount in the range of 40 to 70% of its original length.

25. The process in accordance with claim 1 wherein in step (f) the body is heated to 2000° F.

26. The process in accordance with claim 1 wherein in step (i) the body is heated to 50° to 200° F. above recrystallization temperature.

27. The process in accordance with claim 1 wherein during the third upset forging operation the body is maintained in a temperature range of 1600° to 1950° F.

28. The process in accordance with claim 1 wherein in the third upset forging operation the body is reduced in length 55 to 65% of its original length.

29. The process in accordance with claim 1 wherein the nickel-base alloy is INCONEL 706.

30. The process in accordance with claim 1 wherein the nickel-base alloy is INCONEL 718.

31. A process for fabricating nickel base alloy large forged parts having fine grain size and improved tensile properties by:

(a) providing a body of a nickel base alloy;
(b) heating said body to a temperature above at least 2000° F. to recrystallize the alloy;
(c) subjecting said body to a first upset forging operation to provide a reduction of between 50 to 70% of the original length of the body, the body being maintained in a temperature range of 50° to 300° F. above recrystallization temperature during said forging operation;
(d) drawing said body after said first upset forging;
(e) heating the body after drawing to a temperature of at least 2000° F. to recrystallize the body and then cooling the body at a rate of 2° to 100° F./hr;
(f) reheating said body to a temperature above 2000° F. to recrystallize said body;
(g) subjecting the reheated body to a second upset forging operation to provide a reduction of at least 25% of the original length of the body while maintaining said reheated body in a temperature range of 1700° to 2000° F.;
(h) heating and maintaining said second upset forged body in a temperature range of 1700° to 1950° F. while subjecting said second upset forged body to a third upset forging operation to provide a reduction in the length in a range of 55 to 65% of the original length of the second upset forged body; and
(i) solution heat treating, quenching and aging to provide a forged product having improved tensile properties.

32. In a process for fabricating a nickel base alloy forged turbine disc or spacer having fine grain size by:

(a) providing a body of a nickel base alloy;
(b) heating said body to a temperature above the recrystallization temperature of the alloy;
(c) subjecting said body to a first upset forging operation to provide a reduction of at least 50% of the original length of the body;
(d) drawing said body after said first upset forging;
(e) subjecting the body after drawing to a recrystallization treatment and cooling at a rate of 2° to 100° F./hr;
(f) reheating said body to a temperature above the recrystallization temperature;
(g) subjecting the reheated body to a second upset forging operation to provide a reduction of at least 25% of the original length of the body;
(h) heating and maintaining said second upset forged body in a temperature of at least 50° to 200° F. and below the recrystallization temperature while subjecting said second upset forged body to a third upset forging operation to provide a reduction in the length of at least 50% of the original length of the second upset forged body to provide a forged product for forming into said turbine disc or spacer; and
(i) solution heat treating, quenching and aging said forged product.

33. The process in accordance with claim 32 wherein the alloy is selected from INCONEL 706, Inconel 718, Inconel 625, WASPALOY and A286.

34. The process in accordance with claim 32 wherein the product, after solution heat treating, quenching and aging, has an ASTM grain size of 3 or finer.

35. The process in accordance with claim 32 wherein the body has a circular cross section.

36. The process in accordance with claim 32 wherein the body in step (a) is heated to at least 2000° F. or higher.

37. The process in accordance with claim 32 wherein in the frit upset forging step the body is reduced in length between 40 to 70% of its original length.

38. The process in accordance with claim 32 wherein the body is maintained at a temperature range of 1700° to 2000° F. during said first upset forging operation.

39. The process in accordance with claim 32 wherein during said redrawing the body is maintained at a temperature range of 1700° to 2100° F.

40. The process in accordance with claim 32 wherein said redrawing imparts to the upset forge body an amount of work substantially equivalent to that imparted by said first upset forging.

41. The process in accordance with claim 32 wherein in step (e) the redrawn body is heated to above 2000° F.

42. The process in accordance with claim 32 wherein in step (e) the body is cooled at a rate of 10° to 90° F./hr.

43. The process in accordance with claim 32 wherein in step (f) the body is heated to above 2000° F.

44. The process in accordance with claim 32 wherein the body is maintained at a temperature in the range of 1700° to 2000° F. during said second upset forging operation.

45. The process in accordance with claim 32 wherein in the second upset forging operation the length of the body is reduced by an amount in the range of 40 to 70% of its original length.

46. The process in accordance with claim 32 wherein during the third upset forging operation the body is maintained in a temperature range of 1800° to 1950° F.

47. The process in accordance with claim 32 wherein in the third upset forging operation the body is reduced in length 50 to 90% of its original length.

48. The process in accordance with claim 32 wherein the nickel-base alloy is INCONEL 706.

49. The process in accordance with claim 32 wherein the nickel-base alloy is INCONEL 718.

50. A process for fabricating nickel base alloy recrystallized large forged parts having fine grain size and improved tensile properties by:

(a) providing a body of a nickel base alloy;
(b) heating said body to a temperature above at least 2000° F. to recrystallize the alloy;
(c) subjecting said body to a first upset forging operation to provide a reduction of between 40 to 70% of the original length of the body, the body being maintained in a temperature range of 1900° to 2100° F.;
(d) drawing said body after said first upset forging;
(e) heating the body after drawing to a temperature of at least 2000° F. to recrystallize the body and then cooling the body at a rate of 2° to 100° F./hr;
(f) reheating said body to a temperature above 2000° F. to recrystallize said body;
(g) subjecting the reheated body to a second upset forging operation to provide a reduction of at least 25% of the original length of the body while maintaining said reheated body in a temperature range of 1700° to 2000° F.;

(h) heating and maintaining said second upset forged body in a temperature range of 1700° to 1950° F. while subjecting said second upset forged body to a third upset forging operation to provide a reduction in the length in a range of 40 to 70% of the original length of the second upset forged body; and (i) solution heat treating, quenching and aging to provide a forged product having improved tensile properties.

51. In a process for fabricating recrystallized, large forged parts having fine grain size from a heat resisting alloy selected from one of nickel-base alloy, iron-nickel-chromium-molybdenum alloy, cobalt-chromium-nickel-base alloy and nickel-cobalt-base alloy wherein a body of said alloy is provided, the improvement wherein said body is heated to above the recrystallization temperature of the alloy and subjected to a first upset forging operation to provide a reduction in the original length of the body followed by redrawing said first upset forged body, recrystallizing prior to upset forging it a second time wherein its length is reduced at least 50%, followed by solution heat treating, quenching and aging, the forged parts having an ASTM grain size of 3 or finer as measured by ASTM E112 Intercept method.

52. The process in accordance with claim 51 wherein the alloy is a nickel-base alloy.

53. The process in accordance with claim 51 wherein the alloy is INCONEL 706.

54. The process in accordance with claim 51 wherein the alloy is recrystallized after the third upset forging step.

55. In a process for fabricating recrystallized forged parts from INCONEL 706 having fine grain size wherein a body of the alloy is provided, the improvement wherein said body is heated to above the recrystallization temperature of the alloy and subjected to a first upset forging operation to provide a reduction in the original length of the body followed by redrawing said first upset forged body, said forged parts further being provided in a condition resulting from recrystallizing said body prior to upset forging it a second time wherein its length is reduced at least 25%, followed by recrystallization and a third upset forging step which provides a reduction in length of at least 75% followed by recrystallization and solution heat treating, quenching and aging, the forged parts having an ASTM grain size of 3 or finer as measured by ASTM E112 Intercept method and a yield strength in the range of 135 to 175 KSI.

56. In a process for fabricating a turbine spacer or a turbine disc for a land-based turbine wherein the spacer or disc is forged from a body of INCONEL 706 alloy, the spacer and turbine disc having a fine grain size, the improvement wherein said body is heated to above the recrystallization temperature of the alloy and subjected to a first upset forging operation to provide a reduction in the original length of the body followed by redrawing said first upset forged body, said forged parts further being provided in a condition resulting from recrystallizing said body prior to upset forging it a second time wherein its length is reduced at least 25%, followed by recrystallization and a third upset forging step which provides a reduction in length of at least 75% followed by recrystallization and solution heat treating, quenching and aging, the forged parts having an ASTM grain size of 3 or finer as measured by ASTM E112 Intercept method and a yield strength in the range of 135 to 175 KSI.

57. In a process for fabricating a turbine spacer or a turbine disc for a land-based turbine wherein the spacer or turbine disc is forged from a body of INCONEL 706 alloy and provided in recrystallized form, the spacer and disc having a fine grain size, the improvement wherein said body is heated to above the recrystallization temperature of the alloy and subjected to a first upset forging operation to provide a reduction in the original length of the body followed by redrawing said first upset forged body, said forged parts further being provided in a condition resulting from recrystallizing said body prior to upset forging it a second time wherein its length is reduced at least 25%, followed by recrystallization and a third upset forging step which provides a reduction in length of at least 75% followed by solution heat treating, quenching and aging, the forged parts having an ASTM grain size of 3 or finer as measured by ASTM E112 Intercept method.

58. A large alloy forging, the forging having an alloy composition selected from one of a nickel base alloy, a cobalt-chromium-nickel base alloy, a nickel-cobalt base alloy and an iron-nickel-chromium-molybdenum alloy, the forging having a grain size of ASTM grain size 3 or finer, as measured by ASTM method E112 and having a tensile strength in the range of 135 to 175 KSI.

59. The forging in accordance with claim 58 wherein the forging has an ultimate tensile strength of 170 to 210 KSI.

60. The forging in accordance with claim 58 wherein the alloy is a nickel base alloy.

61. The forging in accordance with claim 58 wherein the alloy is a cobalt-chromium-nickel base alloy.

62. The forging in accordance with claim 58 wherein the alloy is a nickel cobalt base alloy.

63. The forging in accordance with claim 58 wherein the alloy is a iron-nickel-chromium-molybdenum alloy.

64. The forging in accordance with claim 58 wherein the alloy is selected from INCONEL 706, INCONEL 625 and INCONEL 718.

65. The forging in accordance with claim 58 wherein the forging is a turbine disc.

66. The forging in accordance with claim 58 wherein the forging is a turbine spacer.

67. A recrystallized large alloy forging, the forging having a nickel base alloy composition selected from INCONEL 706, INCONEL 625 and INCONEL 718, the forging having a grain size of ASTM grain size 3 or finer, having a yield strength in the range of 135 to 175 KSI, ultimate tensile strength of 170 to 210 KSI.

68. The forging in accordance with claim 67 wherein the alloy composition is INCONEL 706.

69. The forging in accordance with claim 67 wherein the alloy composition is INCONEL 625.

70. The forging in accordance with claim 67 wherein the alloy composition is INCONEL 718.

71. In the manufacture of a forged turbine spacer or disc product by a process that includes upset forging, the improvement wherein the spacer and disc have an alloy composition selected from one of a nickel base alloy, a cobalt-chromium-nickel base alloy, a nickel-cobalt base alloy and an iron-nickel-chromium-molybdenum alloy, the product is provided in recrystallized form and have a grain size of ASTM grain size 3 or finer, as measured by ASTM method E112 and have a yield strength in the range of 135 to 175 KSI.

72. In the manufacture of a forged turbine spacer or disc product by a process that includes upset forging, the improvement wherein the spacer or disc product has an alloy composition of INCONEL 706, the spacer and disc product provided in recrystallized form and having a grain size of ASTM grain size 3 or finer, as measured by ASTM method E112 and having a yield strength in the range of 135 to 175 KSI.

73. A large alloy forged turbine spacer or disc product for a land-based turbine, the spacer or disc product having an alloy composition selected from one of a nickel base alloy, a cobalt-chromium-nickel base alloy, a nickel-cobalt base alloy and an iron-nickel-chromium-molybdenum alloy, the product having a grain size of ASTM grain size 3 or finer, as measured by ASTM method E112 and having a yield strength in the range of 135 to 175 KSI.

74. A recrystallized large alloy forged turbine spacer or disc product for a land-based turbine, the spacer or disc product having a nickel base alloy composition selected from INCONEL 706, INCONEL 715 and INCONEL 718, the product having a grain size of ASTM grain size 3 or finer, having a yield strength in the range of 135 to 175 KSI, ultimate tensile strength of 170 to 210 KSI.

75. The manufacture of claim 71 in which said product weighs more than about 7,500 pounds.

76. The manufacture of claim 72 in which said product weighs more than about 7,500 pounds.

* * * * *